US005902771A

United States Patent [19]

Slark et al.

[11] Patent Number: 5,902,771

[45] Date of Patent: May 11, 1999

[54] DYE DIFFUSION THERMAL TRANSFER PRINTING

[75] Inventors: Andrew Slark, Stokesley; Alan Butters, Capel St. Mary, both of United Kingdom

[73] Assignee: Imperial Chemical Industries PLC, London, United Kingdom

[21] Appl. No.: 08/945,678

[22] PCT Filed: Apr. 30, 1996

[86] PCT No.: PCT/GB96/01023

§ 371 Date: Oct. 30, 1997

§ 102(e) Date: Oct. 30, 1997

[87] PCT Pub. No.: WO96/34768

PCT Pub. Date: Nov. 7, 1996

[30] Foreign Application Priority Data

May 2, 1995 [GB] United Kingdom ..... 9508879

[51] Int. Cl.[6] ..... B41M 5/035; B41M 5/38

[52] U.S. Cl. ..... 503/227; 428/195; 428/500; 428/521; 428/522; 428/913; 428/914

[58] Field of Search ..... 8/471; 428/195, 428/500, 521, 522, 913, 914; 503/227

[56] References Cited

U.S. PATENT DOCUMENTS 4,772,582 9/1988 DeBoer ..... 503/227

*Primary Examiner*—Bruce H. Hess
*Attorney, Agent, or Firm*—Pillsbury Madison & Sutro

[57] ABSTRACT

A thermal transfer printing dye sheet comprising a substrate, a dye coat comprising a dye and a polymeric binder on the substrate and an over coat of styrene/butadiene copolymer on the dye coat is disclosed.

5 Claims, No Drawings

DYE DIFFUSION THERMAL TRANSFER PRINTING

INTRODUCTION

This invention relates to dye diffusion thermal transfer printing (DDTTP or D2T2 printing, D2T2 is a trade mark of Imperial Chemical Industries PLC)

It is known to print woven or knitted textile material by a thermal transfer printing (TTP) process. In such a process a sublimable dye is applied to a paper substrate (usually as an ink also containing a resinous or polymeric binder to bind the dye to the substrate until it is required for printing) in the form of a pattern, to produce a transfer sheet comprising a paper substrate printed with a pattern which it is desired to transfer to the textile. Substantially all the dye is then transferred from the transfer sheet to the textile material, to form an identical pattern on the textile material, by placing the patterned side of the transfer sheet in contact with the textile material and heating the sandwich, under light pressure from a heated plate, to a temperature from 180–220° C., for a period of 30–120 seconds.

As the surface of the textile substrate is fibrous and uneven it will not be in contact with the printed pattern on the transfer sheet over the whole of the pattern area. It is therefore necessary for the dye to be sublimable and vaporise during passage from the transfer sheet to the textile substrate in order for dye to be transferred from the transfer sheet to the textile substrate over the whole of the pattern area.

As heat is applied evenly over the whole area of the sandwich over a sufficiently long period for equilibrium to be established, conditions are substantially isothermal, the process is non-selective and the dye penetrates deeply into the fibres of the textile material.

In DDTTP, a dye sheet is formed by applying a heat-transferable dye (usually in the form of a solution or dispersion in a liquid also containing a polymeric or resinous binder to bind the dye to the substrate) to a thin (usually <20 micron) substrate having a smooth plain surface in the form of a continuous even film over the entire printing area of the dye sheet. Dye is then selectively transferred from the transfer sheet by placing it in contact with a material having a smooth surface with an affinity for the dye, hereinafter called the receiver sheet, and selectively heating discrete areas of the reverse side of the dye sheet for periods from about 1 to 20 milliseconds (msec) and temperatures up to 300° C., in accordance with a pattern information signal, whereby dye from the selectively heated regions of the dye sheet diffuses from the dye sheet to the receiver sheet and forms a pattern thereon in accordance with the pattern in which heat is applied to the dye sheet. The shape of the pattern is determined by the number and location of the discrete areas which are subjected to heating and the depth of shade in any discrete area is determined by the period of time for which it is heated and the temperature reached.

Heating is generally, though not necessarily, effected by a line of heating elements, over which the receiver and transfer sheets are passed together. Each element is approximately square in overall shape, although the element may optionally be split down the centre, and may be resistively heated by an electrical current passed through it from adjacent circuitry. Each element normally corresponds to an element of image information and can be separately heated to 300° C. to 400° C., in less than 20 msec and preferably less than 10 msec, usually by an electric pulse in response to a pattern information signal. During the heating period the temperature of an element will rise to about 300–400° C. over about 5–8 msec. With increase in temperature and time more dye will diffuse from the dye sheet to the receiver sheet and thus the amount of dye transferred onto, and the depth of shade at, any discrete area on the receiver sheet will depend on the period for which an element is heated while it is in contact with the reverse side of the dye sheet.

As heat is applied through individually energised elements for very short periods of time the process is selective in terms of location and quantity of dye transferred and the transferred dye remains close to the surface of the receiver sheet.

As an alternative heating may be effected using a light source in a light-induced thermal transfer (LITT or L2T2 printing, L2T2 is a trade mark of Imperial Chemical Industries PLC) printer where the light source can be focused, in response to an electronic pattern information signal, on each area of the dye sheet to be heated. The heat for effecting transfer of the dye from the dye sheet is generated in the dye sheet which has an absorber for the inducing light. The absorber is selected according to the light source used and converts the light to thermal energy, at a point at which the light is incident, sufficient to transfer the dye at that point to the corresponding position on the receiver sheet. The inducing light usually has a narrow waveband and may be in the visible, infra-red or ultra violet regions although infra-red emitting lasers are particularly suitable.

In DDTTP it is important that the surfaces of the dye sheet and receiver sheet are even so that good contact can be achieved between the printed surface of the dye sheet and the receiving surface of the receiver sheet over the entire printing area because it is believed that the dye is transferred substantially by diffusion in the molten state in condensed phases. Thus, any defect or speck of dust which prevents good contact over any part of the printing area will inhibit transfer and lead to an unprinted portion on the receiver sheet on the area where good contact is prevented, which can be considerably larger than the area of the speck or defect. The surfaces of the substrate of the dye and receiver sheets are usually a smooth polymeric film, especially of a polyester, which has some affinity for the dye.

The temperature and pressure involved during the thermal transfer printing process produce ideal conditions for adhesion between the polymeric materials forming the dye sheet and the receiver sheet preventing clean separation of the dye sheet from the receiver sheet after printing.

It is known to overcome this problem by incorporating suitable release material into the receiver coat. Silicone-type materials are particularly well known for this purpose. However, further problems then arise as the receiver coat chemistry can change with ageing causing differences in product performance and the presence of the release material at the surface of the receiver coat can affect adhesion of a protective overlayer, eg in security laminates.

These latter problems may be overcome by providing the dye sheet with release properties, for example by overcoating the dye coat with a layer of hydroxypropymethyl cellulose as disclosed in GB-B-2157841.

Whilst this solution is satisfactory when the polymer of the receiver sheet is polyester, when more hydrophilic polymers, such as poly (vinyl pyridine) or poly vinyl pyrrolidone are used total transfer occurs. The adhesion between the dye coat and the receiver coat is so strong that failure occurs at the interface between the dye coat and substrate with the result that the complete dye coat, ie the dye and the polymer transfer.

According to one aspect of the present invention, there is provided a dye sheet comprising a substrate, a dye coat comprising a dye and a polymeric binder on the substrate and an over coat of styrenelbutadiene copolymer on the dye coat.

According to a further aspect of the invention, there is provided a thermal transfer printing dye sheet/receiver sheet combination in which the dye sheet comprises a substrate, a dye coat comprising a dye and a polymeric binder on the substrate and an over coat of styrene/butadiene copolymer on the dye coat and in which the receiver sheet comprises a substrate having thereon a receiver coat consisting of a polymer more hydrophilic than polyester such as poly (vinyl pyridine), poly (vinyl pyrrolidone) or a vinyl pyrrolidone/vinyl acetate copolymer.

The over coat may have a thickness of 0.01 to 0.5 $\mu$m, preferably 0.05 to 0.25 $\mu$m.

The ratio of styrene to butadiene may be from 1:2 to 2:1

The over coat may be applied as a 0.5 to 3% w/w solution in a suitable organic solvent such as hexane.

According to a preferred aspect of the invention, the dye has the formula

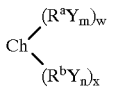

in which

Ch is a chromogen

Ra and Rb each independently is a spacer group

Y is an interactive functional group w and x each independently is 0 or an integer equal to or greater than 1, and m and n each independently is an integer equal to or greater than 1, provided that w and x are not both equal to 0 and when one of w or x is 0 at least one of m and n is equal to or greater than 2.

In this specification, the term "chromogen" is defined as meaning the arrangement of atoms which substantially governs the absorbance of electromagnetic radiation by the dye molecule and particularly in the case of visible radiation, the arrangement of atoms which causes the dye molecule to be coloured.

The spacer groups represented by $R^a$ and $R^b$ may be any groups capable of carrying one or more interactive functional groups (Y) and minimising steric and electronic effects of the Y group and thereby minimising any changes in the absorption characteristics of the chromogen group Ch and thus shade which the Y group would otherwise cause.

Preferably the spacer groups each comprise an atom or group of atoms connected to the chromagen by at least one sigma bond and to the interactive group by at least one sigma bond.

The spacer groups may contain at least one of a carbon, silicon or sulphur atom, preferably two carbon atoms and more preferably from three to ten carbon atoms.

The interactive functional group represented by Y are such that the Y groups on different dye molecules may be interact with each other to form dye complexes of larger size and thus of lower mobility and/or the Y groups may interact with a dye receptive polymer such as those mentioned above, on the receiver sheet. The Y groups may be the same or different and the $R^a$ and $R^b$ may carry one more Y groups. The interactions between different Y groups or between the Y groups and the dye receptive polymer produces an image on the receiver sheet which is resistant to crystallisation and migration of the dyes is minimised. The Y groups are preferably selected from OH, $NH_2$, NHR, $NR_2$, COOH, $CONH_2$, NHCOR, CONHR, SO2NH$_2$, SO2NHR, $SO_3H$, $NHCONH_2$, NHCONHR, =NOH, and $PO_3H$, in which R is selected from —CN, $NO_2$, —Cl, —F, —Br, $C_{1-6}$ alkyl, $C_{1-6}$ alkoxy, —$NHCOC_{1-6}$ alkyl, —NHCOphenyl, —$NHSO_2$ alkyl $NHSO_2$phenyl or aryloxy, Preferred dyes for use in the dye coat are described in the following examples or are disclosed in co-pending PCT application claiming priority from Applications Nos GB 9508810.0, 9508874.6 and GB 9508880.3

The Coating

The coating suitably comprises a binder together with a dye or mixture of dyes. The ratio of binder to dye is preferably at least 0.7:1 and more preferably from 1:1 to 4:1 and especially preferably 1:1 to 2:1 in order to provide good adhesion between the dye and the substrate and inhibit migration of the dye during storage.

The coating may also contain other additives, such as curing agents, preservatives, etc., these and other ingredients being described more fully in EP 133011A, EP 133012A and EP 111004A.

The Binder

The binder may be any resinous or polymeric material suitable for binding the dye to the substrate which has acceptable solubility in the ink medium, i.e. the medium in which the dye and binder are applied to the transfer sheet. It is preferred however, that the dye is soluble in the binder so that it can exist as a solid solution in the binder on the transfer sheet. In this form it is generally more resistant to migration and crystallisation during storage. Examples of binders include cellulose derivatives, such as ethylhydroxyethylcellulose (EHEC), hydroxypropylcellulose (HPC), ethylcellulose, methylcellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral, polyvinyl acetoacetal and polyvinyl pyrrolidone; polycarbonates such as AL-71 from Mitsubishi Gas Chemicals and MAKROLON 2040 from Bayer (MAKROLON is a trade mark); polymers and co-polymers derived from acrylates and acrylate derivatives, such as polyacrylic acid, polymethyl methacrylate and styrene-acrylate copolymers, styrene derivatives such as polystyrene, polyester resins, polyamide resins, such as melamines; polyurea and polyurethane resins; organosilicones, such as polysiloxanes, epoxy resins and natural resins, such as gum tragacanth and gum arabic. Mixtures of two or more of the above resins may also be used, mixtures preferably comprise a vinyl resin or derivative and a cellulose derivative, more preferably the mixture comprises polyvinyl butyral and ethylcellulose. It is also preferred to use a binder or mixture of binders which is soluble in one of the above-mentioned commercially acceptable organic solvents.

The Substrate

The substrate may be any sheet material preferably having at least one smooth even surface and capable of withstanding the temperatures involved in DDTTP, i.e. up to 400° C. for periods up to 20 msec, yet thin enough to transmit heat applied on one side through to the dyes on the other side to effect transfer of the dye onto a receiver sheet within such short periods. Examples of suitable materials are polymers, especially polyester, polyacrylate, polyamide, cellulosic and polyalkylene films, metallised forms thereof, including co-polymer and laminated films, especially laminates incorporating a smooth even polyester receptor layer on which the dye is deposited. Thin (<20 micron) high quality paper of even thickness and having a smooth coated surface, such as capacitor paper, is also suitable. A laminated substrate preferably comprises a backcoat, on the opposite side of the laminate from the receptor layer, which, in the printing process, holds the molten mass together, such as a thermosetting resin, e.g a silicone, acrylate or polyurethane resin, to separate the heat source from the polyester and prevent melting of the latter during the DDTTP operation. The thickness of the substrate depends to some extent upon its thermal conductivity but it is preferably less than 20 μm and more preferably less than 10 μm.

The following non-limiting examples illustrate the invention.

EXAMPLE 1

Dye sheet samples were prepared by coating 6 μm thick polyethylene terephthalate substrate (supplied by Diafoil) from a solution containing

| | |
|---|---|
| dye | 2.1% w/w |
| poly(vinyl butyral) | 2.1% w/w |
| tetrahydrofuran | 95.8% w/w |

using a K2 wire bar, drying the resultant coating at 110° C. for 20 seconds and overcoating the dried dye coat with a 1.2% w/w solution in hexane of a copolymer containing equal amounts of styrene and butadiene (Europrene Sol S141 from Enichem) using a K2 wire bar to give a final release layer 0.15 μm thick.

Further samples were prepared in the same way with the omission of the release layer for comparison purposes.

Receiver sheet samples were prepared by coating 140 μm polyethylene terephthalate substrate (Melinex® 990 from ICI) with a solution containing

| | |
|---|---|
| polymer | 11.1% w/w |
| solvent | 89.9% w/w |

using a K4 wire bar and drying the resulting coating at 140° C. for 3 minutes.

The dyes used were 1) an azopyridone as used in commercial dye sheets and having the formula

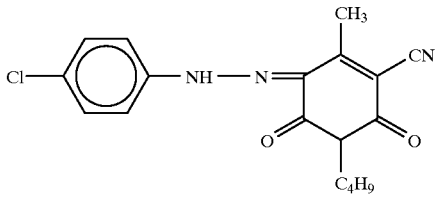

2) a dye having the formula

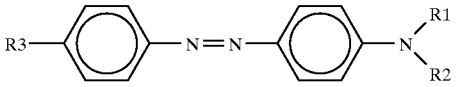

where R1 and R2 are aliphatic carboxyl groups and R3 is alkyl;

3) as dye 2 except that R1, R2, and R3 are aliphatic hyroxyl groups;

4 a propyl analogue of azopyridone having a melting point of 288° C. and the formula

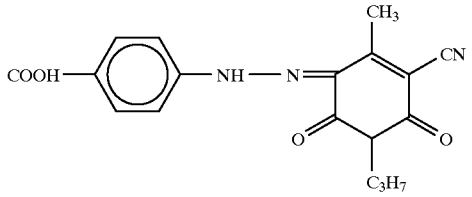

The receiver sheet polymers used were

A) polyester (Vylon® 200 from Toyobo)

B) poly(vinyl pyridine)

C) poly (vinyl pyrrolidone)

D) vinyl pyrrolidone/vinyl acetate copolymer (VA64 from BASF)

Polymers A, B and C were coated from tetrahydrofuran and polymer D was coated from water.

Each possible dye sheet/receiver sheet combination was printed using a laboratory thermal printer having a head voltage of 12V for a print time of 18 ms. There was no problem of separation in the presence of the release layer and a satisfactory image was obtained. In the absence of the release layer it was not possible to produce an image because of high adhesion between the dye coat and the receiver coat. This led to interfacial failure at the substrate/dye coat interface causing the whole dye coat to transfer.

We claim:

1. A thermal transfer printing dye sheet comprising a substrate, a dye coat comprising a dye and a polymeric binder on the substrate and an over coat of styrene/butadiene copolymer on the dye coat.

2. A thermal transfer printing dye sheet according to claim 1, in which the over coat has a thickness of 0.01 to 0.5 μm.

3. A thermal transfer printing dye sheet according to claim 1, in which the dye has the formula

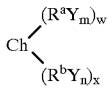

in which

Ch is a chromogen as herein defined

Ra and Rb each independently is a spacer group

Y is an interactive functional group w and x each independently is 0 or an integer equal to or greater than 1, and m and n each independently is an integer equal to or greater than 1, provided that w and x are not both equal to 0 and when one of w or x is 0 at least one of m and n is equal to or greater than 2.

4. A thermal transfer printing dye sheet/receiver sheet combination in which the dye sheet comprises a substrate, a dye coat comprising a dye and a polymeric binder on the substrate and an over coat of styrene/butadiene copolymer on the dye coat and in which the receiver sheet comprises a substrate having thereon a receiver coat consisting of a polymer more hydrophilic than polyester.

5. A thermal transfer printing dye sheet/receiver sheet combination according to claim 4, in which the receiver coat polymer is poly (vinyl pyridine), poly (vinyl pyrrolidone) or a vinyl pyrrolidone/vinyl acetate copolymer.

* * * * *